US006287244B1

(12) United States Patent
Boos

(10) Patent No.: US 6,287,244 B1
(45) Date of Patent: Sep. 11, 2001

(54) METHOD FOR OBVIATING KNEE JOINT INJURY

(76) Inventor: John L. Boos, 313 Manhattan Ave., North Babylon, NY (US) 11704

( * ) Notice: Subject to any disclaimer, the term of this patent is extended or adjusted under 35 U.S.C. 154(b) by 0 days.

(21) Appl. No.: 09/505,800

(22) Filed: Feb. 17, 2000

(51) Int. Cl.[7] ..... A63B 26/00

(52) U.S. Cl. ..... 482/142; 482/145; 482/144; 482/907

(58) Field of Search ..... 482/140, 142, 482/145, 144, 907; 606/241; 128/845, 846

(56) References Cited

U.S. PATENT DOCUMENTS 5,060,937 * 10/1991 Rushatz et al. ..... 272/93
5,190,513 * 3/1993 Habing et al. ..... 482/145
5,205,804 * 4/1993 Hall ..... 482/141
6,001,051 * 12/1999 Chaun-Pin ..... 482/131

* cited by examiner

*Primary Examiner*—Jerome W. Donnelly
*Assistant Examiner*—Lori Baker Amerson
(74) *Attorney, Agent, or Firm*—Myron Amer PC

(57) ABSTRACT

A construction and mode of use of an exercise device primarily for extension exercise routines which hold each knee of the exerciser, by a restraint, at an obtuse angle or in an injury-obviating position during repetitive opposite direction bending at the waist during which, the weight-shifting of the upper torso, can cause injury to an unrestrained knee.

1 Claim, 2 Drawing Sheets

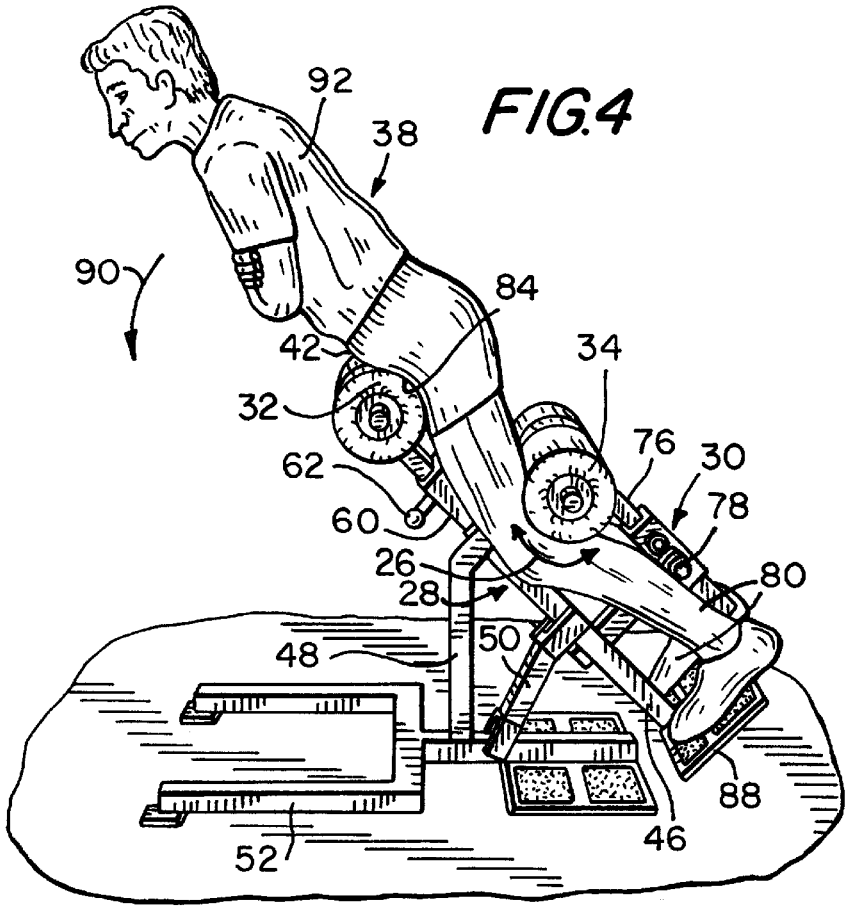
FIG.4
FIG.5
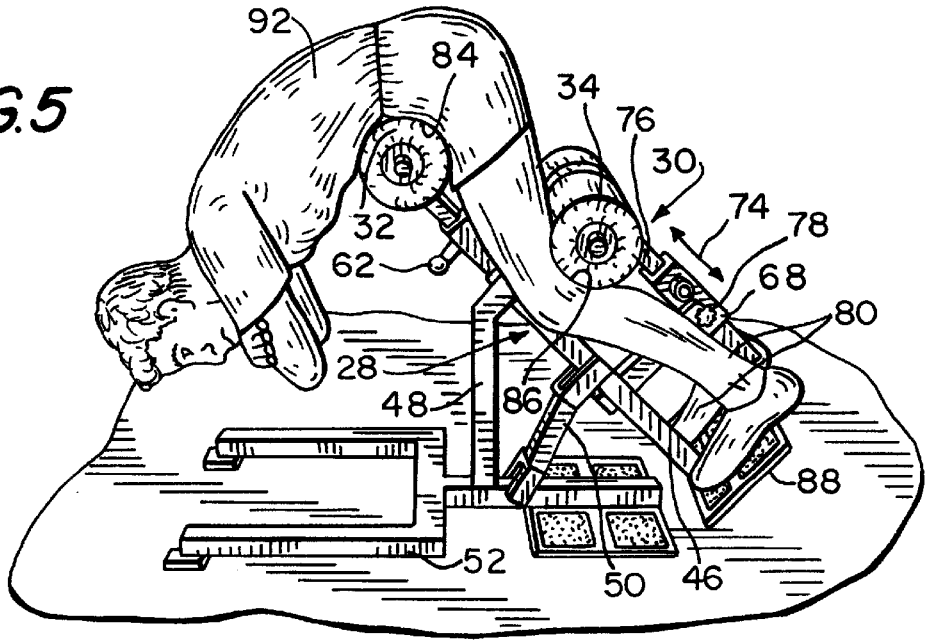

METHOD FOR OBVIATING KNEE JOINT INJURY

The present invention relates generally to improvements in exercise devices, the improvements more particularly focusing on lower back rehabilitation and specifically on an operational mode of an exercise device to prevent knee, gluteal, and lumbosacral strains associated with extension exercise routines, all as will be better understood as the description proceeds.

EXAMPLE OF THE PRIOR ART

Exercise devices for rehabilitation, strengthening goals, and other such benefits are already well known and documented in prior patents, as exemplified by U.S. Pat. No. 5,190,513 for "Dual Station Exercise Bench" issued to Habing et al. on Mar. 2, 1993. The access to and use of one of these exercise devices, however, does not assure that it will result in a benefit to the user, since the way it is used could actually cause injury. For example, it has been found in practice that performing on extension apparatus without providing posterior femoral support could, and often does result in severe knee joint injury and injury to lower back muscles, i.e., the gluteal, quadratous lumborum, and the hamstrings.

Broadly, it is an object of the present invention to overcome the foregoing and other shortcomings of the prior art.

More particularly, it is an object of the present invention to provide an exercise device which by its construction dictates, preparatory to its use that an injury-obviating position be assumed by the exerciser to thusly avoid the occurrence of injury.

The description of the invention which follows, together with the accompanying drawings should not be construed as limiting the invention to the example shown and described, because those skilled in the art to which the invention appertains will be able to devise other forms thereof within the ambit of the appended claims.

FIGS. 4 and 5 illustrate, also in side elevational views, but in sequence the performance of the exercise routine.

Figure 1:
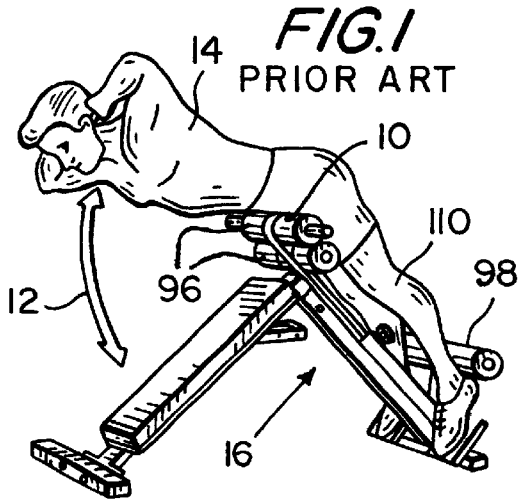
FIG.1 PRIOR ART
FIG. 1 is a perspective view of a prior art exercise device and an exercising routine performed thereon.

Shown in FIG. 1, and documented in U.S. Pat. No. 5,190,513, is a known exercise performed by repetitive opposite direction bending at the waist 10, in the directions of the arrow 12, by the exerciser 14 using an exercise device, generally designated 16, the construction and use of which is well known from U.S. Pat. No. 5,190,513 and is to be understood to be incorporated by this reference in this patent application as if fully set forth herein.

Figure 2:
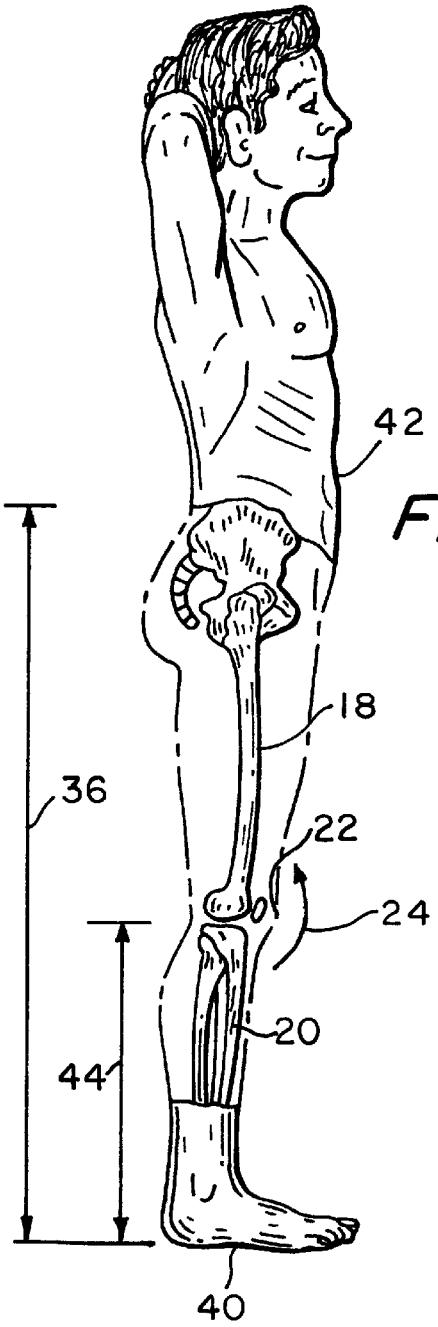
FIG. 2 is a simplified side elevational view of the anatomy effected by the exercise routine generally depicted in FIG. 1.

Before reverting back to FIG. 1, it is helpful in better understanding the invention to refer first to FIG. 2 in which the anatomy, and more specifically the femur bone and tibia bone are respectively identified, as at 18 and 20, which anatomically are at the juncture of, and articulate at the knee 22. Underlying the present invention is the recognition that during exercising any knee flexing in the direction 24, if not controlled as to extent, will result in serious injury to the knee 22 and/or to the user's hamstring (not shown in FIG. 2). Thus to prevent this happenstance, the knee 22 is physically restrained in an obtuse angle 26 (see FIGS. 4, 5) and, at this angle, is in what can aptly be characterized as a safe knee position, depicted generally, as at 28, for doing hyperextensions as illustrated in sequential FIGS. 4 and 5.

Figure 3:
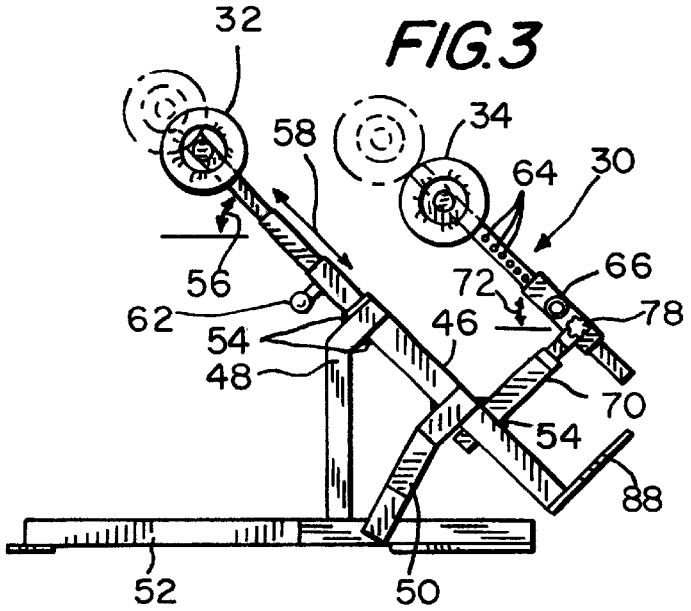
FIG. 3 is a side elevational view of an exercise device for practicing the exercising routine according to the present invention.

Except for means for positioning so as to insure a safe knee position 28 during hyperextensions 12 embodied only in the FIGS. 3–5 exercise device, generally designated 30, and not embodied in the '513 device 16 and in all other known devices, it will be understood that the construction of device 16 and of device 30 is similar; thus, it is believed that a complete understanding of the invention does not require a detailed description of this known similar construction.

The positioning means which characterize the operating mode of the exercise device 30 provide positions of two pairs of adjacent supports 32 and 34 each of comfort-friendly plush or elastomeric construction material, the former support 32 being correlated to the length 36 of the lower torso of the exerciser 38 as measured from his sole 40 to his waist 42 and the latter support 34 correlated to his foot length 44 also as measured from his sole 40 but only up to his knee 22.

The preferred positioning means for the support 32 consists of a hollow support bar 46, rectangular in cross section, mounted on cooperating upstanding support brackets 48 and 50 from a base 52 as by welds, individually and collectively designated 54, at an angular orientation subtending an included angle 56 to the horizontal effective to establish a path of movement 58. To this end, a cooperating hollow support bar 60, also rectangular in cross section but slightly undersized with respect to the hollow core of bar 46, so as to allow for a sliding clearance therebetween, has an operative position in telescoped relation to the bar 46. It will be understood that the bars 46 and 60 respectively have lines of openings which, in use, provide a selected pair of openings in alignment with each other for receiving in inserted relation therethrough a popper pin 62, which establishes a desired position along the path of movement 58 of the support 32, such as at the position of movement depicted in full line, or at a range of other positions, as depicted in phantom perspective in FIG. 3. The referred to cooperating line of openings on bars 46 and 60 are similar to the opening, individually and collectively designated 64 and 66.

The preferred positioning means for the support 34 consists of a hollow support bar 68, rectangular in cross section, mounted on a cooperating support bracket 70 extending from a site of its weld attachment to the bar 68, at an angular orientation subtending an included angle 72 to the horizontal effective to establish a path of movement 74. To this end, a cooperating hollow support bar 76, also rectangular in cross section but slightly undersized with respect to the hollow core of bar 68, so as to allow for a sliding clearance therebetween, has an operative position in telescoped relation to the bar 68. The positions of movement of the support 34, using the previously referred to aligned openings 64 and 66 and a popper pin 78, are those along the path of movement and depicted in full line and phantom line perspective.

The staring exercise position of the exerciser 38 is illustrated in FIG. 4. In preparation for assuming the FIG. 4 position, the assumed positions of the supports 32 and 34 are respectively correlated to the dimensions 36 and 44 of FIG. 2. In practice, use of the same angles 56 and 72 are effective in establishing the paths of movement 58 and 74 in substantial parallel relation to each other, which assures that there is sufficient clearance in front of support 32 and behind support 34 for the exerciser 38 to assume the FIG. 4 starting position. To this end, the feet 80 of the exerciser 38 straddle the bar 46 having the clearance in front of support 34 to do so, and positions his lower waist 42 against support 32, as at 84, and just below his knee 22 has positioned, as at 86, the support 34 which constrains the knee 22 from moving in the direction 24. The exerciser 38 is instructed to position his feet 80 on a foot rest 88 welded at the end of bar 68 so that there is an obtuse angle 26 flex in his feet 22, a condition previously noted as being proper for an exercise routine of hypertensions 90.

In FIG. 5, the exerciser 38 is shown moving through a forward waist bend 90 which, of course, causes a weight shift of his upper torso 92 in front of the support 32. Although this weight shift has a tendency to be a hyper condition giving rise to a stress possibility for the knee 22, the restraint of the support 34 strategically located behind the knee 22 obviates any injury occurring to the knee 22.

In contrast, as shown in FIG. 1, the restraint applied by a stationary support 96 at its only position possible, is behind the heel 98 of the exerciser 14 and thus ineffective in obviating injury to the exerciser's knee 110. The failure to provide this safeguard is believed due to a lack of understanding that the noted weight shift induces in the muscular anatomy of the exerciser 14 the knee condition of FIG. 1, which is significantly vulnerable to knee injury.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In the exercise mode of operation of an exercise device during which the upper torso at the waist of a user is repetitively moved forward and back to provide lower back muscular development, an improved method consisting of obviating knee joint injury during said repetitive movements comprising the steps of:

(a) determining a first length of a lower torso of an exerciser as measured from a sole to a waist of said exerciser;

(b) determining a second length of a foot of said exerciser as measured from a sole to a knee joint of said exerciser;

(c) providing a first support in a raised operative position correlated to said first length for an exercise at a waist junction of an upper torso and depending legs so as to permit said repetitive movements of said upper torso relative to said depending legs held in a stationary condition;

(d) providing a second support in an angular relation rearwardly and below said first support and in a raised operative position correlated to said second length as a positioning site so as to be contacted by a leg area adjacent a knee joint; and (e) instructing an exerciser to assume an exercising position in contact with said first and second supports so as to cause said exerciser's femur bone and tibia bone to subtend an obtuse angle, whereby the exerciser has an optimum flexed knee condition to obviate injury to the knee joint.

* * * * *